US011366418B2

(12) United States Patent
Momiyama

(10) Patent No.: US 11,366,418 B2
(45) Date of Patent: Jun. 21, 2022

(54) DECURLING DEVICE AND IMAGE FORMING APPARATUS INCLUDING THE SAME

(71) Applicant: FUJIFILM Business Innovation Corp., Tokyo (JP)

(72) Inventor: Hiroyuki Momiyama, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/854,849

(22) Filed: Apr. 21, 2020

(65) Prior Publication Data

US 2021/0103245 A1 Apr. 8, 2021

(30) Foreign Application Priority Data

Oct. 7, 2019 (JP) ..... JP2019-184393

(51) Int. Cl.
*G03G 15/00* (2006.01)
*G03G 15/20* (2006.01)

(52) U.S. Cl.
CPC ..... *G03G 15/6576* (2013.01); *G03G 15/2028* (2013.01); *G03G 15/6529* (2013.01); *G03G 15/6567* (2013.01); *G03G 2215/00704* (2013.01)

(58) Field of Classification Search
CPC ..... G03G 15/6567; G03G 15/5029; G03G 15/5062; G03G 2215/0129
See application file for complete search history.

(56) References Cited

U.S. PATENT DOCUMENTS 6,965,750 B2 * 11/2005 Muratani ..... G03G 15/6576 271/188
7,298,981 B2 11/2007 Oohara et al.
2007/0201890 A1 * 8/2007 Oh ..... G03G 15/2039 399/67
2012/0099875 A1 * 4/2012 Yagi ..... G03G 15/6573 399/16
2012/0301198 A1 * 11/2012 Momiyama ..... B65H 9/06 399/361
2013/0004214 A1 * 1/2013 Sakaya ..... G03G 15/2028 399/323

FOREIGN PATENT DOCUMENTS

JP 2006023427 1/2006

* cited by examiner

*Primary Examiner* — Jessica L Eley
(74) *Attorney, Agent, or Firm* — JCIPRNET

(57) ABSTRACT

A decurling device is provided on a downstream side with respect to a fixing device in a medium transporting direction and straightens a curl formed in a medium transported to the decurling device. The decurling device includes a bending unit extending across the medium transporting direction and that bends the medium in a decurling direction by coming into contact with a leading end of the medium; and a position adjusting unit that adjusts, in a medium crosswise direction, tilt of a contact part of the bending unit, the contact part coming into contact with the leading end of the medium exited from the fixing device.

19 Claims, 12 Drawing Sheets

DECURLING DEVICE AND IMAGE FORMING APPARATUS INCLUDING THE SAME

CROSS-REFERENCE TO RELATED APPLICATIONS

This application is based on and claims priority under 35 USC 119 from Japanese Patent Application No. 2019-184393 filed Oct. 7, 2019.

BACKGROUND

(i) Technical Field

The present disclosure relates to a decurling device and an image forming apparatus including the same.

(ii) Related Art

A decurling device is disclosed by, for example, Japanese Unexamined Patent Application Publication No. 2006-023427.

Japanese Unexamined Patent Application Publication No. 2006-023427 relates to an image forming apparatus including a first fixing unit having a heater thereinside, a second fixing unit provided face to face with the first fixing unit, a pair of transporting rollers provided on the downstream side with respect to the first and second fixing units in a direction of transport of a recording material, a guide with which the recording material exiting from the pair of transporting rollers is urged toward the first fixing unit from behind one of the transporting rollers, and a unit that urges the guide toward the recording material.

SUMMARY

Aspects of non-limiting embodiments of the present disclosure relate to a decurling device capable of substantially evenly straightening a curl at a leading end of a medium in accordance with the state of any skew of the medium exited from a fixing device, and also relate to an image forming apparatus including the same.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a decurling device provided on a downstream side with respect to a fixing device in a medium transporting direction and that straightens a curl formed in a medium transported to the decurling device. The decurling device includes a bending unit that extends across the medium transporting direction and that bends the medium in a decurling direction by coming into contact with a leading end of the medium; and a position adjusting unit that adjusts, in a medium crosswise direction, tilt of a contact part of the bending unit, the contact part coming into contact with the leading end of the medium exited from the fixing device.

BRIEF DESCRIPTION OF THE DRAWINGS

Exemplary embodiments of the present disclosure will be described in detail based on the following figures, wherein.

DETAILED DESCRIPTION

General Embodiment

Figure 1A:
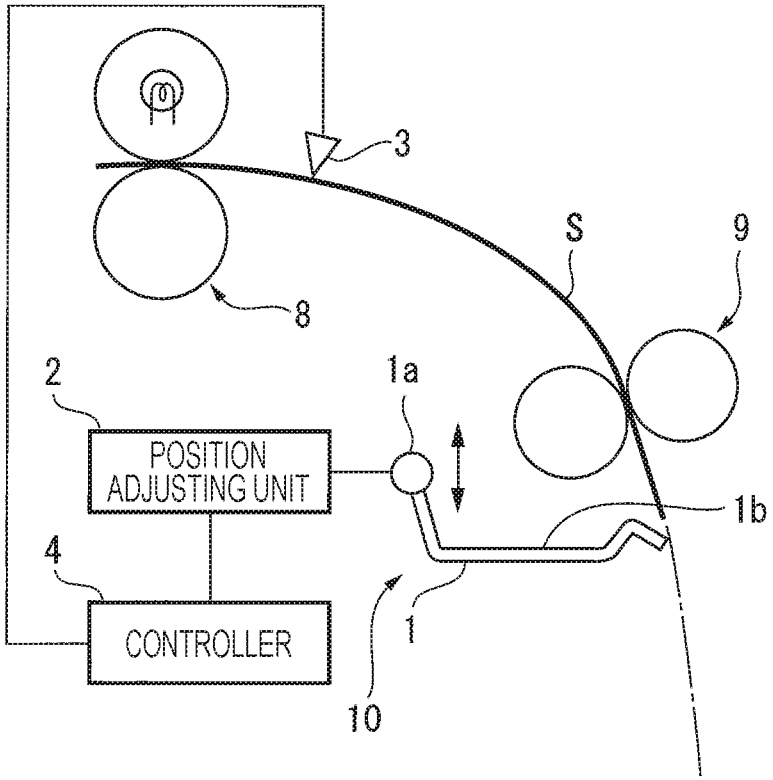
FIG. 1A illustrates an image forming apparatus including a decurling device according to a general embodiment of the present disclosure.
Figure 1B:
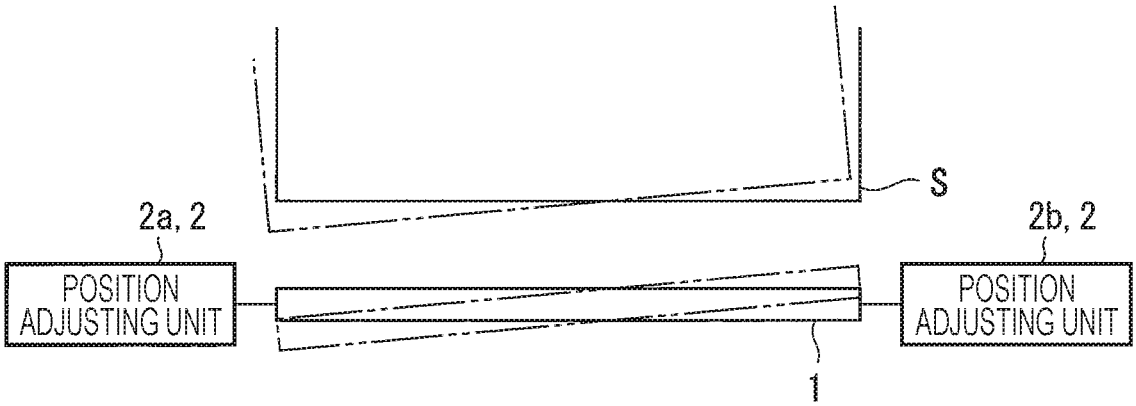
FIG. 1B illustrates how the decurling device behaves.

FIGS. 1A and 1B illustrate an image forming apparatus including a decurling device according to a general embodiment of the present disclosure.

The image forming apparatus illustrated in FIGS. 1A and 1B includes a fixing device 8 that thermally fixes an unfixed image on a medium S, and a decurling device 10 provided on the downstream side with respect to the fixing device 8 in a direction of transport of a medium S (hereinafter referred to as "medium transporting direction"). The decurling device 10 straightens a curl formed in the medium S transported thereto. A transporting unit 9 is provided on the downstream side with respect to the fixing device 8 in the medium transporting direction.

In the general embodiment, the decurling device 10 includes a bending unit 1 extending across the medium transporting direction and that bends the medium S in a decurling direction by coming into contact with a leading end of the medium S; a position adjusting unit 2 that adjusts, in a crosswise direction of the medium S (hereinafter referred to as "medium crosswise direction"), the tilt of a contact part of the bending unit 1, the contact part coming into contact with the leading end of the medium S exited from the fixing device 8; a skew detector 3 that detects the state of skew of the medium S exited from the fixing device 8 with respect to a reference line extending in the medium transporting direction; and a controller 4 that controls the length of travel of the position adjusting unit 2 in accordance with information detected by the skew detector 3.

In terms of space saving, the above technique is typically applied to a case where the bending unit 1 includes a plate-shaped guiding member 1*b*. However, the above technique is not limited to such a case and is applicable to various cases including a case where a pair of rollers that bend a medium in a decurling direction by utilizing the shape of a contact part defined between the rollers are employed for decurling.

The present disclosure has been made in view of a fact that particularly a thick medium is more likely to skew, because of a greater load, at nip sites of the fixing device 8 and the transporting unit 9. However, needless to say, the present disclosure may also be applied to cases where any medium other than a thick medium is employed as the medium S.

The position adjusting unit 2 adjusts the tilt of the contact part of the bending unit 1 that comes into contact with the medium S. Therefore, even if the medium S exited from the fixing device 8 is skewed, the tilt of the contact part of the bending unit 1 that comes into contact with the medium S is adjustable. Specifically, if the leading end of a skewed medium S comes into contact with the bending unit 1, the tilt of the bending unit 1 is adjusted in accordance with the state of skew of the medium S.

Employing the position adjusting unit 2 capable of adjusting the skew by using the bending unit 1 is one of the technical features of the general embodiment. As other technical features, the general embodiment in which the tilt of the bending unit 1 is adjusted in accordance with the state of skew of the medium S further employs the skew detector 3 that detects the state of skew of the medium S, and the controller 4 that controls the length of travel of the position adjusting unit 2 in accordance with the result of detection by the skew detector 3.

Now, representative and other examples of the decurling device according to the general embodiment will be described.

In a representative example of the bending unit 1, the bending unit 1 includes a plate-shaped guiding member 1*b* positioned in a predetermined orientation with a part thereof serving as a support point 1*a*, the guiding member 1*b* guiding the leading end of the medium S.

In the above representative example, the bending unit 1 may include an urging unit (not illustrated) that urges the guiding member 1*b* toward the medium S. The urging unit is selected considering the following. A thick medium, which has a predetermined thickness or greater, has such a rigidity that the medium may push the guiding member 1*b* against an urging force exerted by the urging unit. Therefore, when a thick medium having a predetermined thickness or grater is made to pass the bending unit 1, the guiding member 1*b* of the bending unit 1 may be retracted in such a manner as to rotate on the support point 1*a*, against the urging force of the urging unit.

As another example of the bending unit 1, if the transporting unit 9 provided between the fixing device 8 and the bending unit 1 includes a plurality of separate transporting members arranged at intervals in the medium crosswise direction and each having a nipping site where the medium S is nipped, the guiding member 1*b* of the bending unit 1 may be positioned avoiding the separate transporting members. In such an example, the bending unit 1 is positioned closer to the transporting unit 9.

As an example of the position adjusting unit 2, the bending unit 1 may have the support point 1*a* at each of two ends in the medium crosswise direction, and the position adjusting unit 2 (specifically, position adjusting units 2*a* and 2*b*) may be capable of adjusting individual positions of the support points 1*a* at the two ends of the bending unit 1.

As another example of the position adjusting unit 2, the position adjusting unit 2 may adjust the tilt of the contact part of the bending unit 1 by determining the amount of adjustment in the medium transporting direction with reference to a center position of the bending unit in the medium crosswise direction. In such an example, since the tilt of the bending unit 1 is adjusted with reference to the center position of the bending unit in the medium crosswise direction, the bending unit 1 is to be moved in two directions. Instead, the length of travel of each of the two medium-crosswise-direction ends of the bending unit 1 is smaller than in a case where the bending unit 1 is moved at one medium-crosswise-direction end thereof with the other end thereof being fixed.

As yet another example of the position adjusting unit 2, the position adjusting unit 2 may include a moving unit that moves the support points 1*a* of the bending unit 1 in a direction substantially parallel to the medium transporting direction, and a restricting unit that restricts ranges of movement of the respective support points.

As a representative example of the controller 4, the controller 4 may execute the adjustment of the position of the bending unit 1 with the position adjusting unit 2 when the result of detection by the skew detector 3 exceeds a tolerable range. In such an example, the position adjustment by the position adjusting unit 2 is not executed when the state of skew of the medium S is within the tolerable range but is executed when the state of skew of the medium S exceeds the tolerable range. The tolerable range for the state of skew of the medium S may be set in advance, on the basis of an experiment or the like, to a range within which decurling of the medium S is not adversely affected even if the tilt of the bending unit 1 is not adjusted.

As another representative example of the controller 4, the controller 4 may execute the adjustment of the position of the bending unit 1 with the position adjusting unit 2 in a thick-medium mode in which the medium S has a predetermined thickness or greater. In such an example, the position adjustment by the position adjusting unit 2 is not executed in a thin-medium mode in which the medium S has a thickness smaller than the predetermined thickness but is executed in the thick-medium mode. This is because the necessity of skew correction with the adjustment of the tilt of the bending unit 1 is lower in the thin-medium mode than in the thick-medium mode. However, needless to say, skew correction with the adjustment of the tilt of the bending unit 1 may be executed in the thin-medium mode as well.

The present disclosure will further be described in detail on the basis of an exemplary embodiment illustrated in the attached drawings.

Exemplary Embodiment

Figure 2:
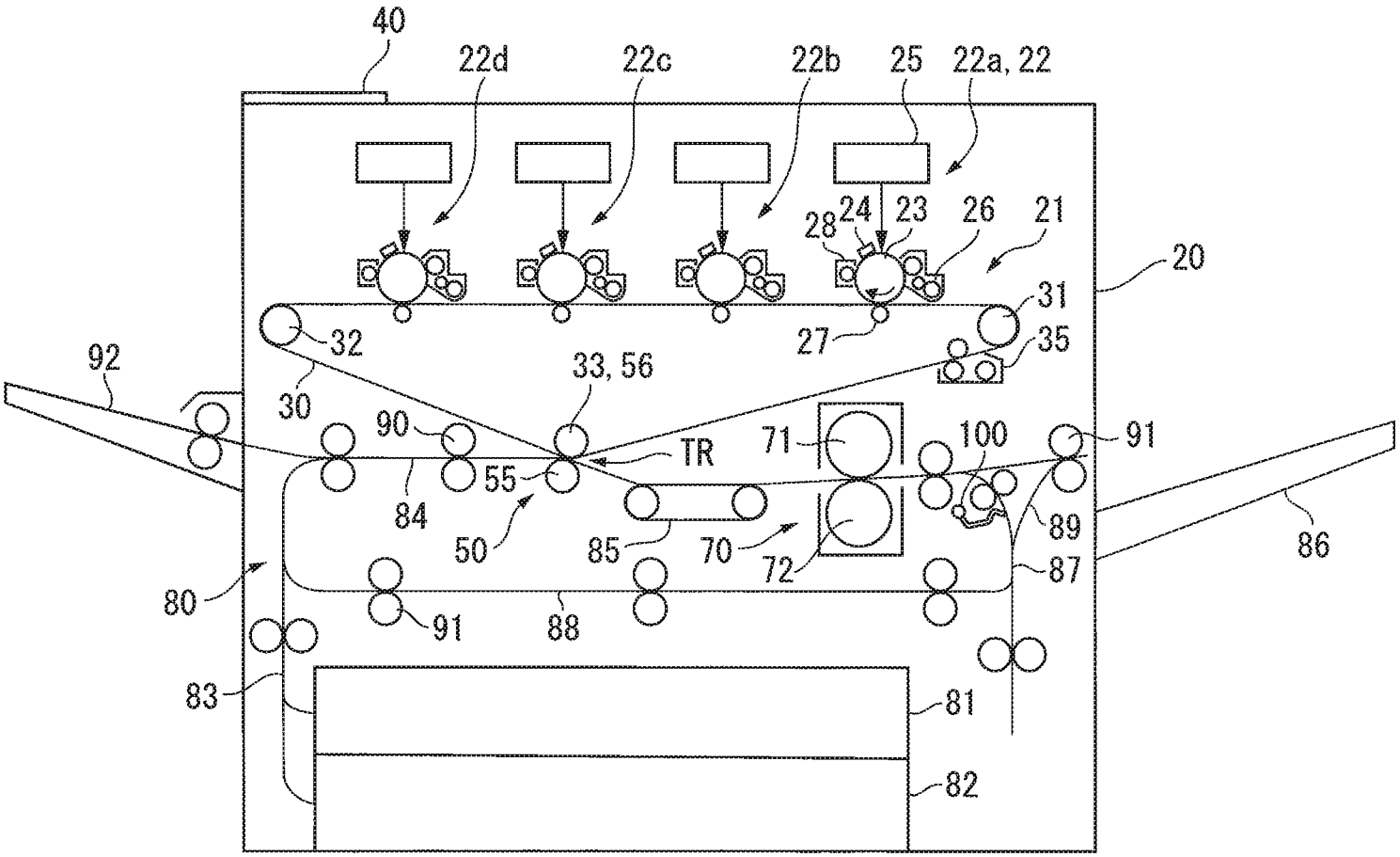
FIG. 2 illustrates an overall configuration of an image forming apparatus according to an exemplary embodiment.

FIG. 2 illustrates an overall configuration of an image forming apparatus according to an exemplary embodiment.

Overall Configuration of Image Forming Apparatus

The image forming apparatus illustrated in FIG. 2 basically includes, in an apparatus housing 20, an imaging engine 21 that forms an image by using, for example, a plurality of color components; a medium transporting system 80 provided below the imaging engine 21 and that transports a medium to the imaging engine 21; and a fixing device 70 that fixes the image formed by the imaging engine 21 to the medium.

The imaging engine 21 according to the present exemplary embodiment includes image forming units 22 (specifically, 22*a* to 22*d*) that form respective images in general colors corresponding to the respective color components (in the present exemplary embodiment, yellow (Y), magenta (M), cyan (C), and black (K)), a belt-type intermediate transfer body 30 to which the color-component images formed by the respective image forming units 22 are sequentially transferred (first-transferred) and held, and a second transfer device (a collective transfer device) 50 with which the color-component images on the intermediate transfer body 30 are second-transferred (collectively transferred) to a medium (a sheet or a film). As illustrated in FIG. 2, the image forming apparatus further includes an operation panel 40 on which the image forming apparatus is operated.

Image Forming Unit

The image forming units 22 (22*a* to 22*d*) according to the present exemplary embodiment each include a drum-type photoconductor 23. The photoconductor 23 is provided therearound with a charging device 24 such as a corotron or a transfer roller that charges the photoconductor 23, an exposure device 25 such as a laser scanning device that forms an electrostatic latent image on the charged photoconductor 23, a developing device 26 that develops the electrostatic latent image on the photoconductor 23 into a toner image with toner containing a corresponding one of the color components of Y, M, C, and K, a first transfer device 27 such as a transfer roller that transfers the toner image from the photoconductor 23 to the intermediate transfer body 30, and a photoconductor cleaning device 28 that removes residual toner from the photoconductor 23.

The intermediate transfer body 30 is stretched around a plurality (three in the present exemplary embodiment) of stretching rollers 31 to 33. The stretching roller 31, for example, is used as a driving roller that is driven by driving motor (not illustrated). The intermediate transfer body 30 is rotated by the driving roller. The image forming apparatus further includes an intermediate-transfer-body-cleaning device 35 provided between the stretching rollers 31 and 33 and that removes residual toner from part of the intermediate transfer body 30 that has undergone the second transfer.

Second Transfer Device (Collective Transfer Device)

The second transfer device (collective transfer device) 50 includes, for example, a transfer roller 55 pressed against the intermediate transfer body 30 at a position across from the stretching roller 33. The stretching roller 33 serves as a counter roller 56 forming a counter electrode for the transfer roller 55. In the present exemplary embodiment, the transfer roller 55 includes a metal shaft provided therearound with an elastic layer such as urethane foam rubber or ethylene-propylene terpolymer (EPDM) containing carbon black or the like. A transfer voltage generated by a transfer power supply (not illustrated) is applied to the counter roller 56 (also serving as the stretching roller 33 in the present exemplary embodiment) through a conductive power feeding roller (not illustrated). Meanwhile, the transfer roller 55 is grounded. Thus, a predetermined transfer electric field is generated between the transfer roller 55 and the counter roller 56. Furthermore, a nip site of the intermediate transfer body 30 that is held between the transfer roller 55 and the counter roller 56 serves as a second transfer site (a collective transfer site) TR. While the second transfer device 50 according to the present exemplary embodiment includes the transfer roller 55, the second transfer device 50 is not limited thereto. Needless to say, the second transfer device 50 may be a transfer belt module or the like including the transfer roller 55 as one of stretching rollers around which a transfer belt is stretched.

Fixing Device

The fixing device 70 includes a thermal fixing roller 71 to be in contact with an image carrying surface of the medium and being rotatable when driven, and a pressure fixing roller 72 pressed against the thermal fixing roller 71 and that rotates by following the thermal fixing roller 71. The fixing device 70 allows the image on the medium to pass through a fixing site defined between the two fixing rollers 71 and 72, thereby fixing the image by applying heat and pressure thereto.

The thermal fixing roller 71 includes, for example, a heater inside a roller body thereof or is provided with an external heater to be brought into contact with the outer peripheral surface of the roller body, so that the roller body is heated. Needless to say, the pressure fixing roller 72 may also be provided with a heater, according to need. While the present exemplary embodiment concerns a case where the fixing device 70 includes a pair of rollers, the fixing device 70 is not limited thereto. The thermal fixing roller 71 may be replaced with, for example, a thermal fixing belt employing an induction heating method, or the like.

Medium Transporting System

The medium transporting system 80 includes a plurality (two in the present exemplary embodiment) of medium supplying containers 81 and 82. The medium transporting system 80 transports a medium from either of the medium supplying containers 81 and 82 to the second transfer site TR through a vertical transport path 83 extending substantially vertically and a horizontal transport path 84 extending substantially horizontally. Subsequently, the medium receives an image transferred thereto, advances along a transporting belt 85 to a fixing part in the fixing device 70, and is discharged to an output medium receiver 86 provided on a side face of the apparatus housing 20.

The medium transporting system 80 further includes a branched transport path 87 branching off downward from the horizontal transport path 84 at a position on the downstream side with respect to the fixing device 70 in the medium transporting direction. The medium is turned over in the branched transport path 87. The medium turned over in the branched transport path 87 is transported into a return transport path 88, is fed into the vertical transport path 83 again, and advances through the horizontal transport path 84 to the second transfer site TR, where another image is transferred to the back side of the medium. Subsequently, the medium passes through the fixing device 70 and is discharged to the output medium receiver 86. The branched transport path 87 includes a branch return path 89 branching off from a halfway position of the branched transport path 87 and through which the medium to be turned over is transported toward the output medium receiver 86.

The medium transporting system 80 further includes a registration roller 90 that sets the medium in position and then supplies the medium to the second transfer site TR, and an appropriate number of transporting rollers 91 provided in the transport paths 83, 84, 87, and 88. Furthermore, the apparatus housing 20 is provided on a side face thereof opposite the output medium receiver 86 with a manual medium feeding device 92 that allows manual feeding of a medium into the horizontal transport path 84.

Necessity of Decurling

In a typical duplex printing mode, a medium having undergone the fixing process in the fixing device 70 and thus having a first image printed on a first side thereof is turned over in the branched transport path 87, advances through the return transport path 88, returns into the vertical transport path 83 and the horizontal transport path 84, and reaches the second transfer site TR, where a second image is second-transferred to a second side of the medium from the intermediate transfer body 30.

In the above process, if, for example, the second side of the medium that carries the second image is heated higher than the first side of the medium by the thermal fixing roller 71 of the fixing device 70, the second side of the medium tends to undergo thermal expansion, causing an end of the medium to curl downward (so-called downcurling). If the medium in such a state is turned over and is transported toward the second transfer site TR, the medium approaches the second transfer site TR with the leading end thereof curling upward (so-called upcurling). However, the upcurled leading end of the medium has difficulty in entering the second transfer site TR. Therefore, the operation of image transfer to the second side of the medium tends to become instable.

Figure 3:
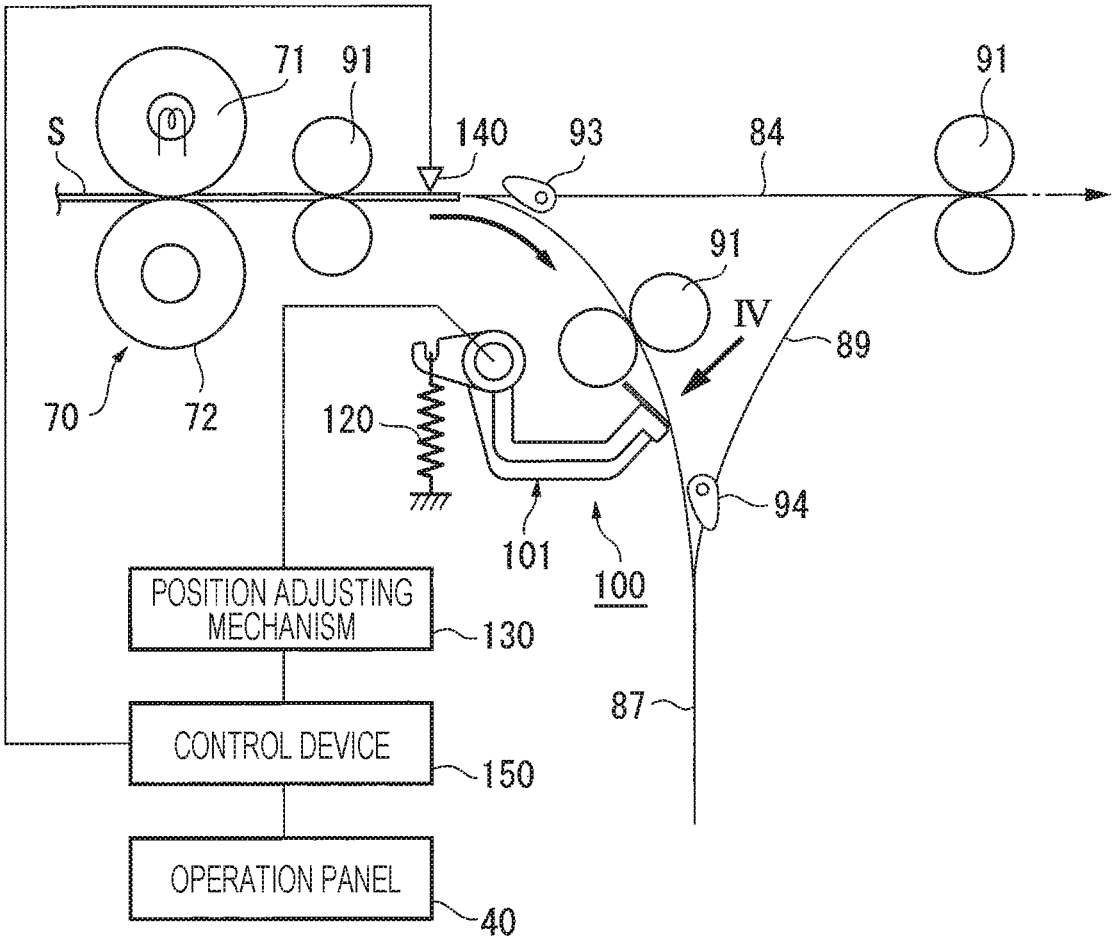
FIG. 3 illustrates details of a decurling device and relevant elements included in the image forming apparatus according to the exemplary embodiment.

Accordingly, as illustrated in FIG. 3, the present exemplary embodiment employs a first switching gate 93 provided at a branching point between the horizontal transport path 84 and the branched transport path 87, a second switching gate 94 provided at a branching point between the branched transport path 87 and the branch return path 89, a transporting roller 91 provided at a position of the branched transport path 87 between the first switching gate 93 and the second switching gate 94, and a decurling device 100 provided on the downstream side with respect to a nip site (corresponding to the contact site) of the transporting roller 91 in the medium transporting direction.

Basic Configuration of Decurling Device

As illustrated in FIGS. 3 to 6, the decurling device 100 according to the present exemplary embodiment includes a guide plate (corresponding to the guiding member) 101 as the bending unit. The guide plate 101 extends across the medium transporting direction and comes into contact with a leading end of a medium S, thereby bending the medium S in a decurling direction.

In the present exemplary embodiment, the guide plate 101 is swingable on a support shaft 110 serving as a support point PO. The support shaft 110 is a single elongated member made of synthetic resin such as polycarbonate (PC) resin and extends in a direction intersecting the medium transporting direction. The guide plate 101 includes arm portions 102 each extending in the radial direction from the support shaft 110 while forming a substantially U sectional shape. The guide plate 101 further includes contact portions 103 projecting from distal ends of the respective arm portions 102 into the transport path provided for the medium S. The leading end of the medium S comes into contact with the contact portions 103. Note that the support shaft 110 according to the present exemplary embodiment includes large-diameter portions 111 and small-diameter portions 112 that are alternately positioned. The arm portions 102 are provided on the respective large-diameter portions 111.

The contact portions 103 each have a substantially flat guiding surface 104. The guiding surface 104 forms a slope in the medium transporting direction such that the medium S passing through a contact site defined between the guiding surface 104 and the transporting roller 91 is bent in the decurling direction (in the first exemplary embodiment, a direction in which the downcurl is straightened). The guiding surface 104 is covered with a smooth protection film 105. The protection film 105 includes an extended portion 106 extending beyond the guiding surface 104 toward a center axis of a driving roller 91*a* included in the transporting roller 91.

In the present exemplary embodiment, the support shaft 110 supporting the guide plate 101 is provided with a pair of projecting members 107 near two respective long-side ends thereof. The projecting members 107 project in a direction opposite to the direction in which the arm portions 102 project. The projecting members 107 each have a catching hook 108 at a distal end thereof. An urging spring 120 is stretched between the catching hook 108 and a predetermined fixed part, so that the guiding surfaces 104 of the guide plate 101 are each set to a predetermined initial position with an urging force exerted by the urging spring 120.

(Positional Relationship Between Guide Plate and Transporting Roller)

Figure 4:
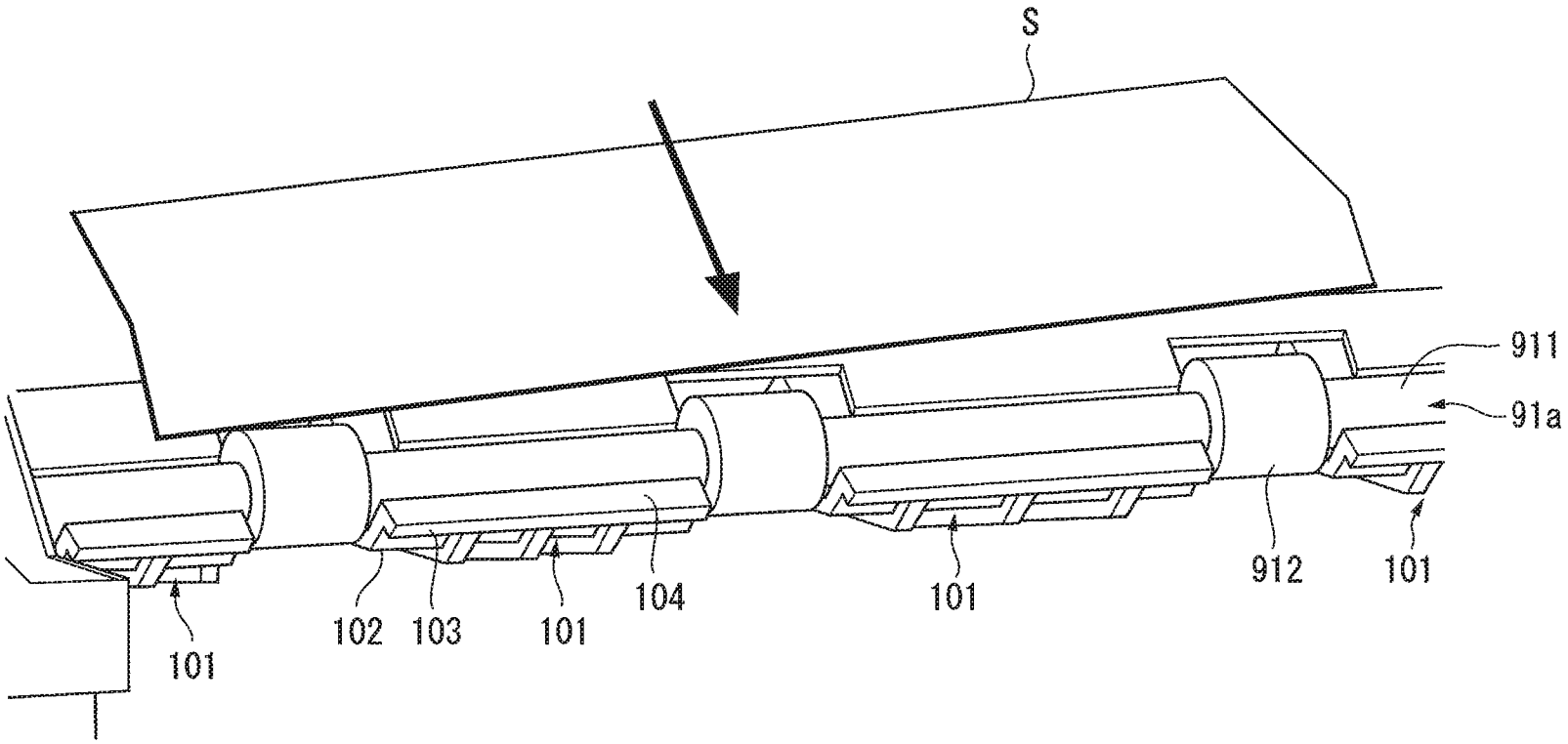
FIG. 4 illustrates the decurling device seen in a direction of arrow IV illustrated in FIG. 3.
Figure 5:
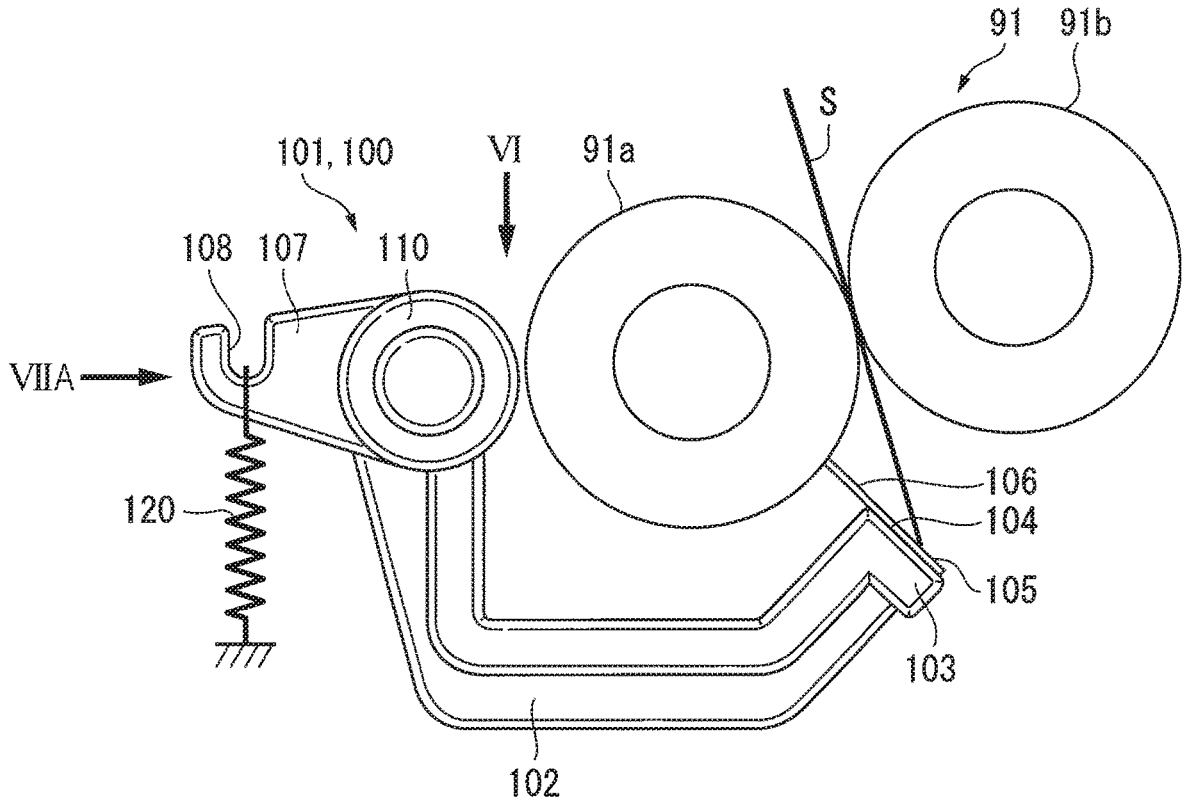
FIG. 5 is an enlargement of the decurling device illustrated in FIG. 3.
Figure 6:
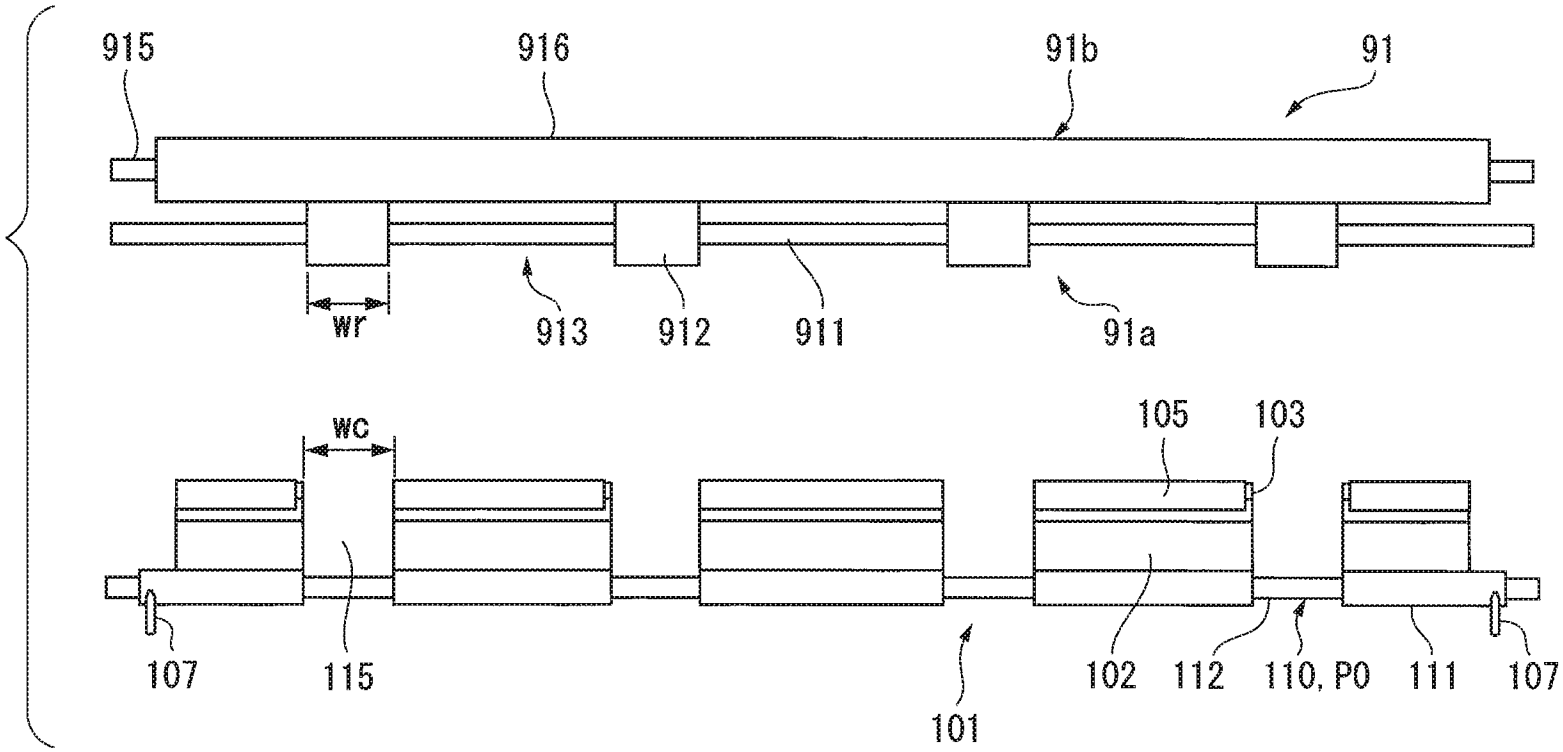
FIG. 6 illustrates the decurling device and a transporting roller originally overlapping each other seen in a direction of arrow VI illustrated in FIG. 5 with the decurling device being retracted substantially horizontally.

In the present exemplary embodiment, as illustrated in FIGS. 4 to 6, the transporting roller 91 provided close to the decurling device 100 includes the driving roller 91*a* and a follower roller 91*b* that rotates by following the driving roller 91*a*. In the present exemplary embodiment, the driving roller 91*a* includes a plurality of separate roller members 912 arranged at intervals on a rotating shaft 911 extending in an axial direction. The follower roller 91*b* includes a continuous roller member 916 provided continuously over a rotating shaft 915 extending in the axial direction.

In the present exemplary embodiment, the guide plate 101 does not interfere with the driving roller 91*a*. Specifically, as illustrated in FIGS. 4 and 6 particularly, the guide plate 101 is configured such that the arm portions 102, inclusive of the contact portions 103, arranged at intervals project at positions corresponding to respective spaces 913 each provided between adjacent ones of the separate roller members 912 of the driving roller 91*a* included in the transporting roller 91. The guide plate 101 has cuts 115 each provided between adjacent ones of the arm portions 102 that are separate from one another. The cuts 115 each have a width we greater than a width wr of each of the separate roller members 912. Therefore, in the present exemplary embodiment, the guide plate 101 of the decurling device 100 is positioned close to the transporting roller 91.

Attention to be Paid when Thick Medium is Used in Decurling Device

Assuming that, for example, not only a thin-type medium having a thickness smaller than a predetermined thickness but also a thick-type medium is used as the medium S to be processed by the decurling device 100, the thick-type medium S is more likely to skew, because of a greater load, than the thin-type medium S when passing through a fixing contact site of the fixing device 70 or the nip site of the transporting roller 91.

If a skewed medium S approaches the guiding surfaces 104 of the guide plate 101 of the decurling device 100, the leading end of the medium S unevenly comes into contact with the guiding surfaces 104 of the guide plate 101. In such a situation, decurling by the decurling device 100 may fail.

Accordingly, the present exemplary embodiment employs a measure conceived in view of skewing of a thick-type medium S, so that the occurrence of failure in decurling by the decurling device 100 is suppressed even if the medium S that is being transported is skewed.

Features of Decurling Device

As illustrated in FIG. 3, the decurling device 100 according to the present exemplary embodiment includes, in addition to the guide plate 101 described above, a position adjusting mechanism 130 as the position adjusting unit that adjusts, in the medium crosswise direction, the tilt of the guiding surfaces 104 of the guide plate 101 that come into contact with the leading end of the medium S exited from the fixing device 70; a skew detecting device 140 as the skew detector that detects the state of skew of the medium S exited from the fixing device 70 with respect to a reference line extending in the medium transporting direction; and a control device 150 that controls the length of travel of the position adjusting mechanism 130 in accordance with information detected by the skew detecting device 140.

(Exemplary Configuration of Position Adjusting Mechanism)

Figure 7A:
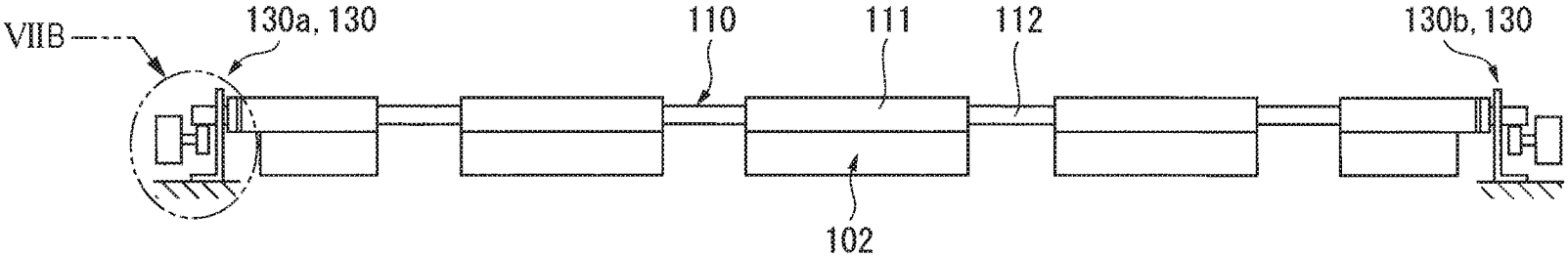
FIG. 7A illustrates the decurling device seen in a direction of arrow VIIA illustrated in FIG. 5.
Figure 7B:
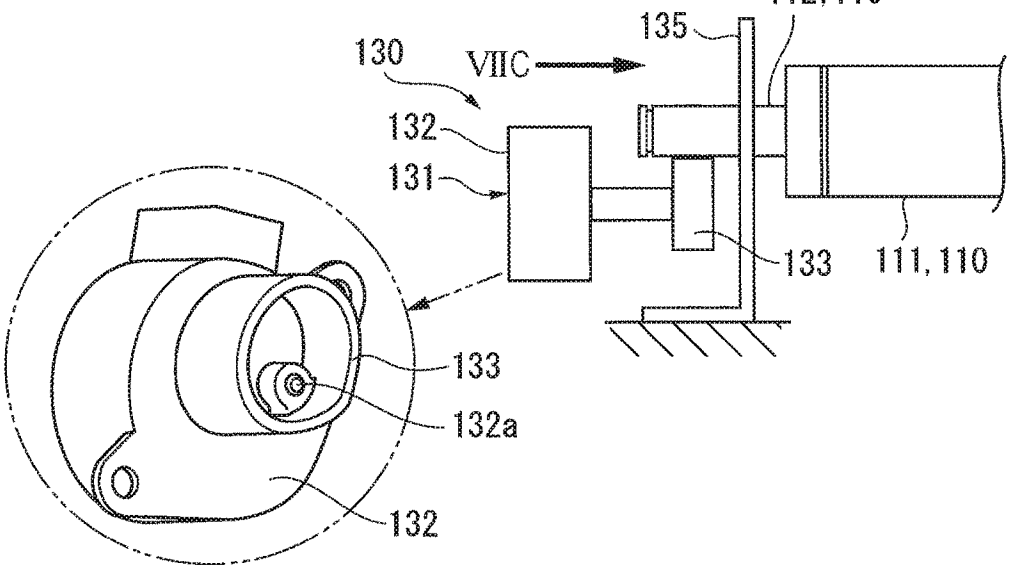
FIG. 7B is an enlargement of part VIIB encircled in FIG. 7A.
Figure 7C:
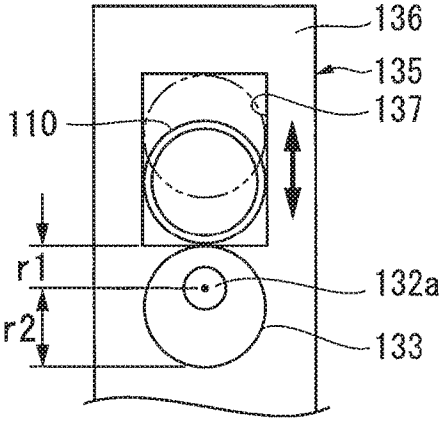
FIG. 7C illustrates the decurling device seen in a direction of arrow VIIC illustrated in FIG. 7B.

In the present exemplary embodiment, as illustrated in FIGS. 7A to 7C, the position adjusting mechanism 130 includes position adjusting mechanisms 130*a* and 130*b* that are capable of individually adjusting the positions of two respective ends of the support shaft 110 that supports the guide plate 101.

In the present exemplary embodiment, the position adjusting mechanisms 130 (130*a* and 130*b*) include respective moving mechanisms 131 as the moving unit that moves the two ends of the support shaft 110 of the guide plate 101 in a direction substantially parallel to the medium transporting direction (in the present exemplary embodiment, an up-and-down direction), and respective restricting frames 135 as the restricting unit that restricts the ranges of movement of the two ends of the support shaft 110.

As illustrated in FIGS. 7B and 7C particularly, the moving mechanisms 131 each include a driving motor 132 such as a stepping motor, and a rotatable cam 133 eccentrically attached to a motor shaft 132*a* of the driving motor 132. Each moving mechanism 131 supports a corresponding one of the two ends of the support shaft 110 by using the cam 133 and moves the end of the support shaft 110 up and down within a range defined by the radial length of the cam 133 between the center and the peripheral surface. The radial length changes between a smallest length r1 and a largest length r2.

The restricting frame 135 includes a restricting frame plate 136 having, for example, an L sectional shape. The restricting frame plate 136 is fixed to a fixed part provided inside the apparatus housing 20. The restricting frame plate 136 has a rectangular restricting slit 137 extending in the up-and-down direction. The end (in the present exemplary embodiment, one of the small-diameter portions 112) of the support shaft 110 is positioned in the restricting slit 137 in such a manner as to be slidable in the up-and-down direction. Thus, the restricting frame 135 restricts the movement of the end of the support shaft 110 in the horizontal direction intersecting the up-and-down direction while allowing the movement of the end of the support shaft 110 in the up-and-down direction.

Figure 8:
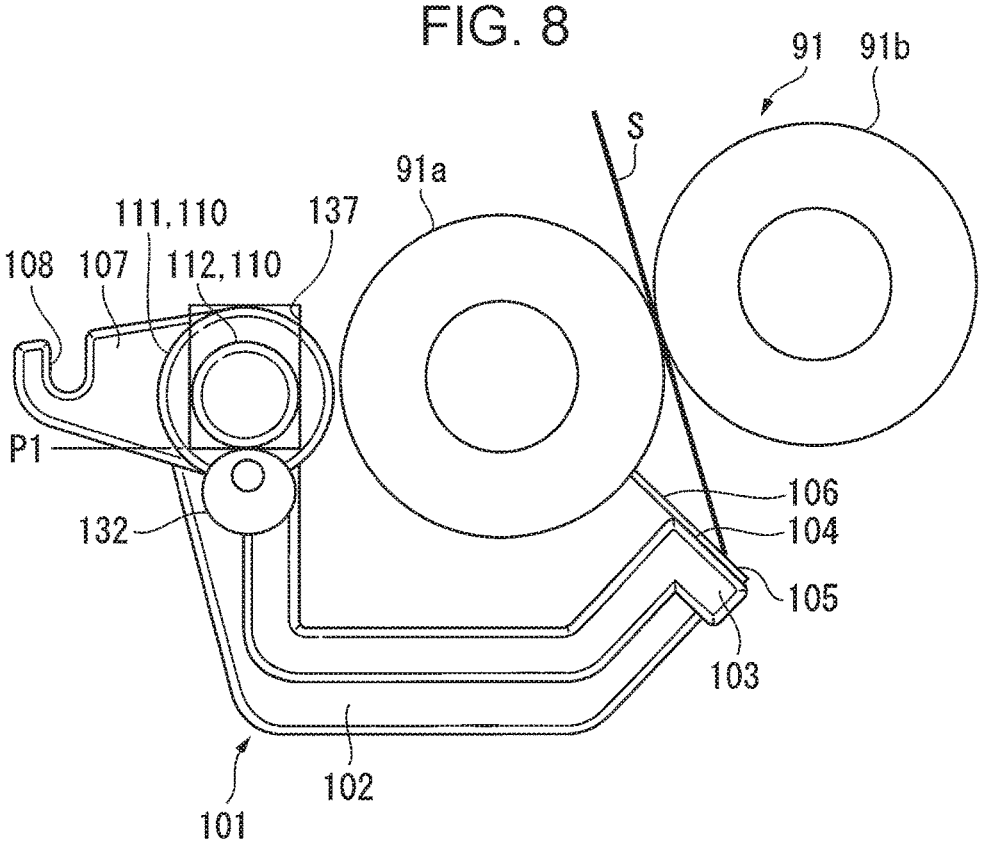
FIG. 8 illustrates the decurling device positioned when a support shaft of a guide plate is at a lowest position.

In the present exemplary embodiment, as illustrated in FIG. 8 for example, in a state where the end of the support shaft 110 of the guide plate 101 is supported by a point of the cam 133 of the moving mechanism 131 where the radial length of the cam 133 between the center and the peripheral surface is the smallest length r1, the end of the support shaft 110 is at a lowest position P1 (in the present exemplary embodiment, a position where the end of the support shaft 110 is in contact with the lower edge of the restricting slit 137).

Figure 9:
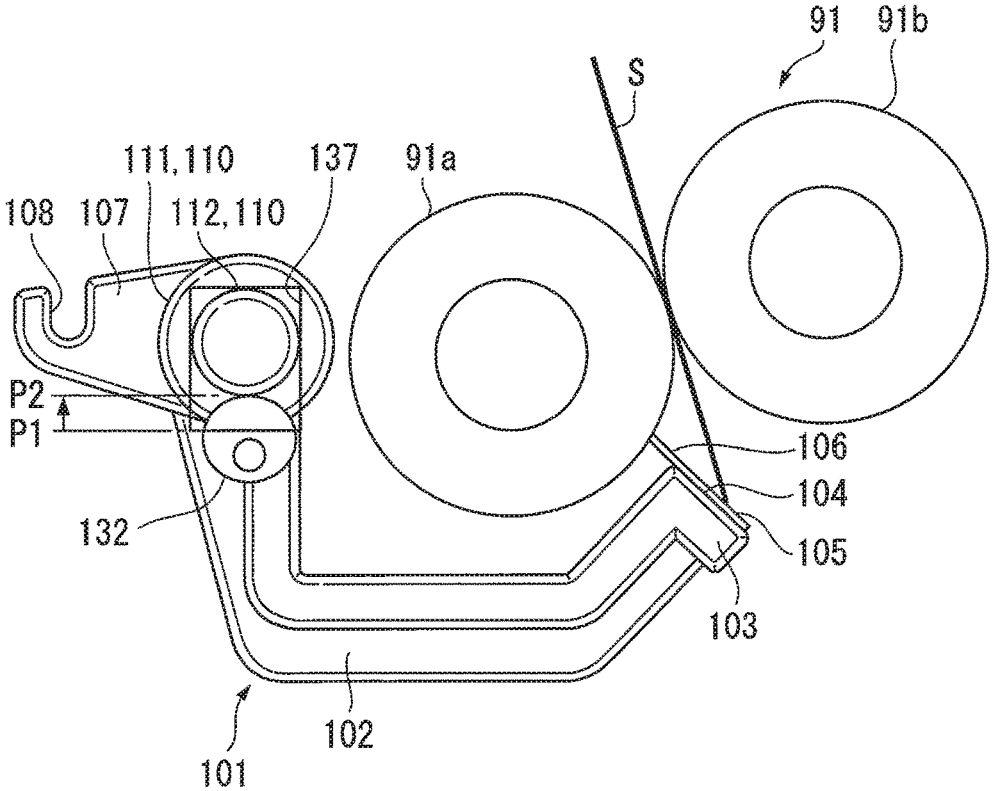
FIG. 9 illustrates the decurling device positioned when the support shaft of the guide plate is at a highest position.

On the other hand, as illustrated in FIG. 9 for example, in a state where the end of the support shaft 110 of the guide plate 101 is supported by a point of the cam 133 of the moving mechanism 131 where the radial length of the cam 133 between the center and the peripheral surface is the largest length r2, the end of the support shaft 110 is at a highest position P2 (in the present exemplary embodiment, a position where the end of the support shaft 110 is in contact with the upper edge of the restricting slit 137).

Detection of Skew of Medium

Figure 12A:
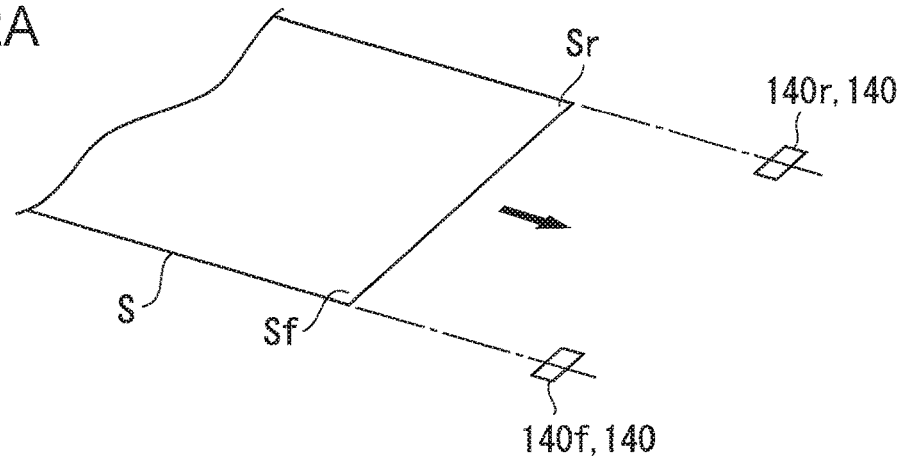
FIG. 12A illustrates an exemplary skew detecting device that detects the state of skew of a medium.

In the present exemplary embodiment, as illustrated in FIGS. 3 and 12A, the skew detecting device 140 includes skew detecting devices 140*f* and 140*r* that are provided on the downstream side in the medium transporting direction with respect to one of the transporting rollers 91 that is positioned subsequently to the fixing device 70 in the horizontal transport path 84. The skew detecting devices 140 are provided at positions corresponding to edges of the medium S that are on two respective sides in the widthwise direction intersecting the medium transporting direction.

In the present exemplary embodiment, a part of the leading end of the medium S that is on the front side of the apparatus housing 20 is defined as front corner Sf, and a part of the leading end of the medium S that is on the rear side of the apparatus housing 20 is defined as rear corner Sr. The skew detecting devices 140 (140*f* and 140*r*) each detect the time point when a corresponding one of the front corner Sf and the rear corner Sr at the leading end of the medium S passes the skew detecting device 140. Note that the skew detecting devices 140 (140*f* and 140*r*) may be selected from the following, according to need: an optical sensor that optically detects the front corner Sf or the rear corner Sr of the medium S, a mechanical sensor such as a limit switch, and the like.

With reference to the result of detection by the skew detecting devices 140 (140*f* and 140*r*), the state of skew at the leading end of the medium S is calculable from the difference in the time point of passage between the front corner Sf and the rear corner Sr of the medium S.

Controlling Position Adjustment for Guide Plate

The control device 150 according to the present exemplary embodiment, illustrated in FIG. 3, is a microcomputer including a central processing unit (CPU), a random access memory (RAM), a read-only memory (ROM), and an input/output port. A position adjusting program (see FIG. 10, for example) created for the guide plate 101 of the decurling device 100 is pre-installed in the ROM. The control device 150 acquires detection signals generated by the respective skew detecting devices 140 and an operation signal transmitted from the operation panel 40 and executes the position adjusting program for the guide plate 101 with the CPU, thereby transmitting control signals to the respective position adjusting mechanisms 130.

Operation of Image Forming Apparatus

According to the present exemplary embodiment, for example, when a duplex printing mode is designated on the operation panel 40, the imaging engine 21 forms a first image. The first image is transferred at the second transfer site TR to a first surface (one side) of a medium S supplied from the medium supplying container 81 or 82. Subsequently, the medium is transported through the fixing device 70, the branched transport path 87, and the return transport path 88 and reaches the second transfer site TR, where a second image formed by the imaging engine 21 is transferred to a second surface (the other side) of the medium S. Then, the medium S is transported through the fixing device 70 again and is discharged to the output medium receiver 86.

Decurling Performed by Decurling Device

In the above image forming process, when the medium S having undergone printing on the one side advances through the branched transport path 87, decurling is performed by the decurling device 100.

(Decurling of Thin Medium)

Figure 11A:
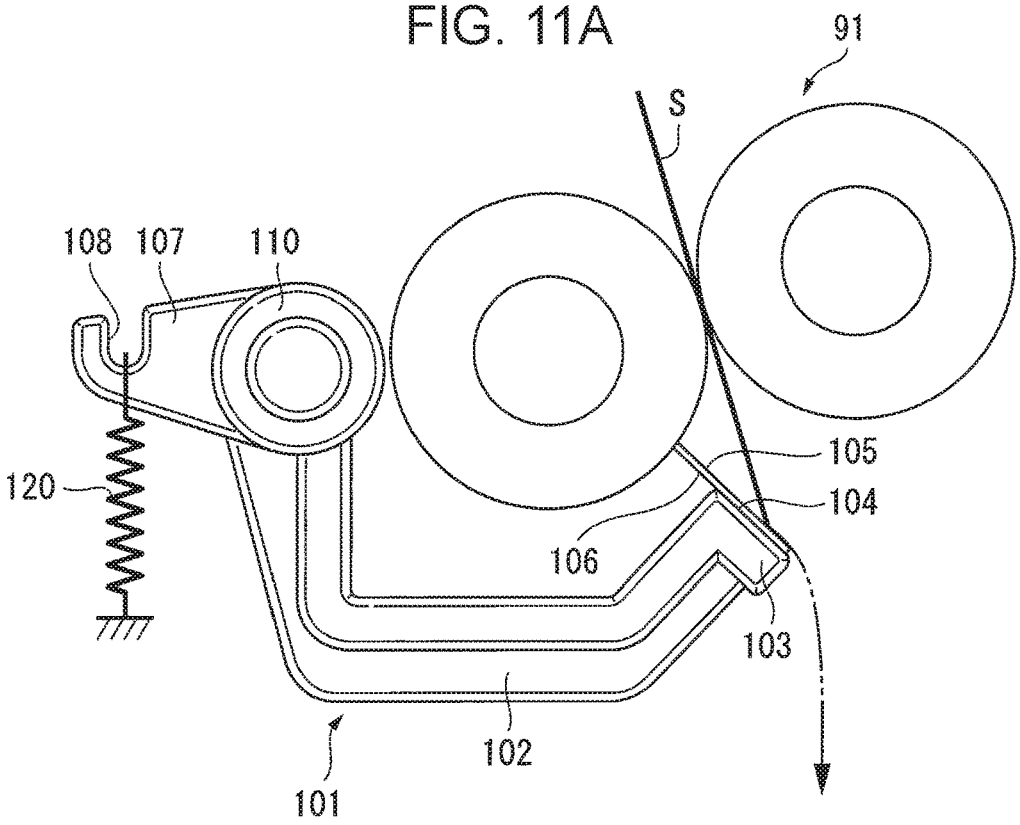
FIG. 11A schematically illustrates a decurling operation performed by the decurling device in a case of a thin medium.

In the present exemplary embodiment, if the medium S is a thin-type medium (a thin medium) having a thickness smaller than a predetermined thickness, the decurling device 100 operates as follows. Referring to FIG. 11A, when the leading end of the medium S exited from the fixing device 70 comes into contact with the guiding surfaces 104 of the guide plate 101, the medium S is guided along the guiding surfaces 104 of the guide plate 101 and then advances over the guiding surfaces 104. This is because the medium S is too soft to generate a pressing force resisting the urging force exerted by the urging spring 120. Therefore, the medium S is bent in the decurling direction. That is, the medium S is decurled.

(Decurling of Thick Medium)

Figure 11B:
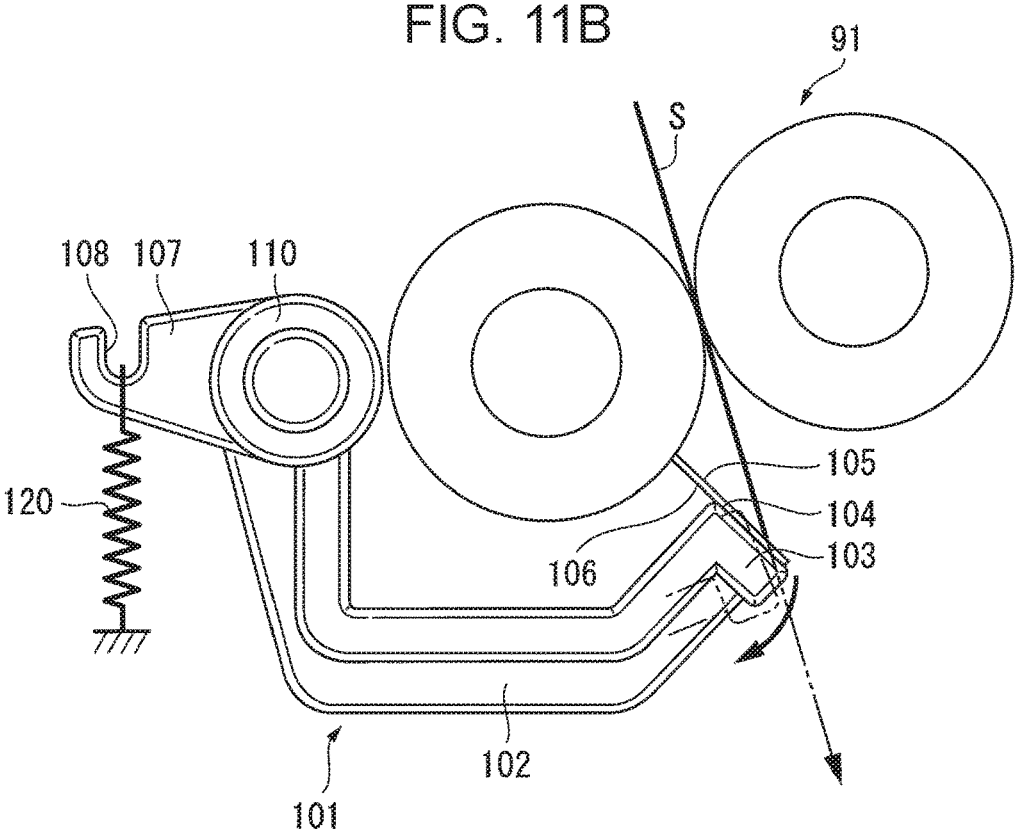
FIG. 11B schematically illustrates a decurling operation performed by the decurling device in a case of a thick medium.

In contrast, for example, if the medium S is a thick-type medium (a thick medium) having a predetermined thickness or greater, the decurling device 100 operates as follows. Referring to FIG. 11B, when the leading end of the medium S exited from the fixing device 70 comes into contact with the guiding surfaces 104 of the guide plate 101, the guiding surfaces 104 of the guide plate 101 are pushed by the medium S that is hard enough to resist the urging force exerted by the urging spring 120. Consequently, the leading end of the medium S advances in a direction substantially parallel to the direction in which the transporting roller 91 transports the medium S. Therefore, in the present exemplary embodiment, the leading end of the thick medium S does not tend to curl very much even after passing through the fixing device 70. Hence, the thick medium S passes the decurling device 100 without being decurled by the decurling device 100.

Adjustment of Tilt of Guide Plate

In the decurling process performed by the decurling device 100 according to the present exemplary embodiment, the control device 150 adjusts the tilt of the guide plate 101 of the decurling device 100.

Figure 10:
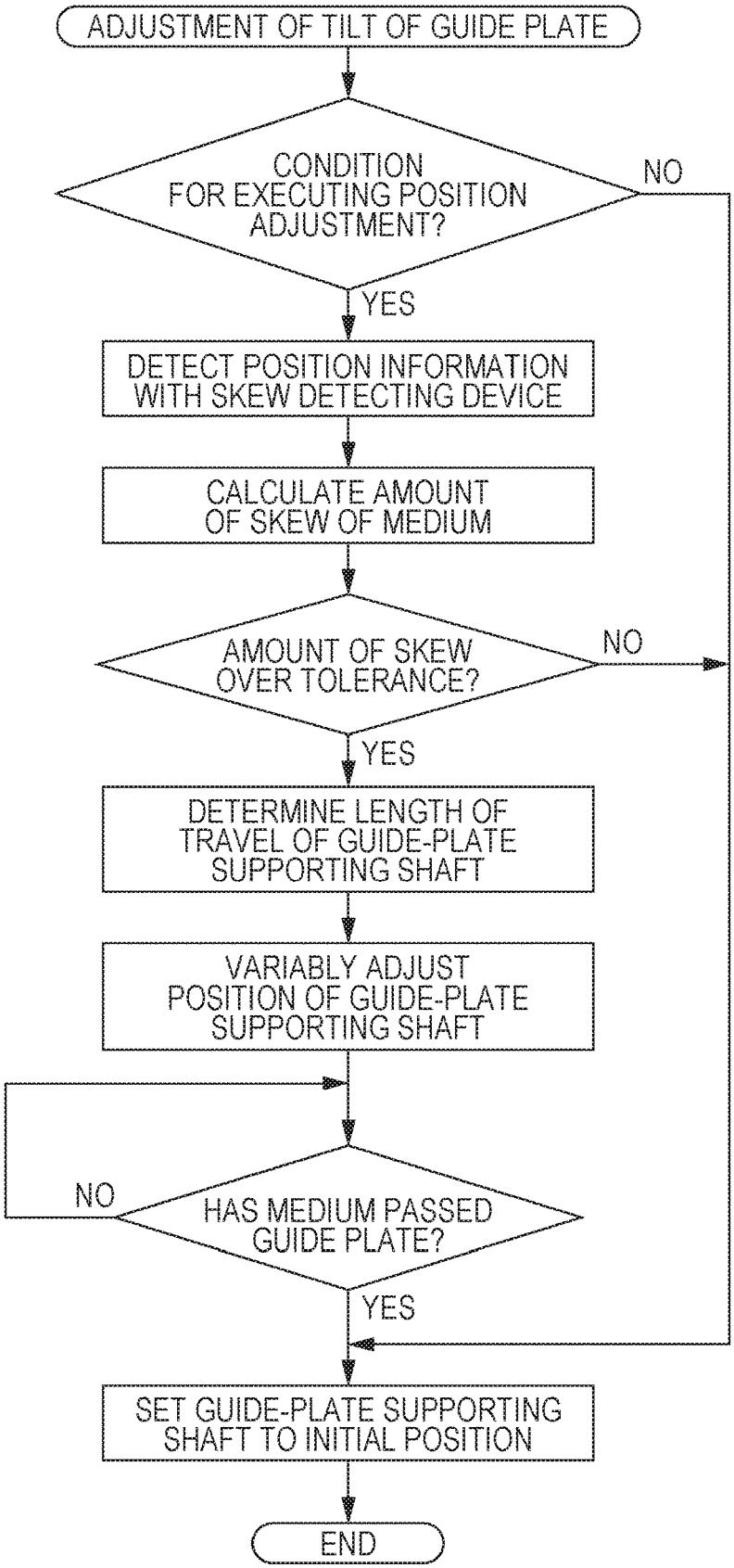
FIG. 10 is a flow chart illustrating a control process for adjusting the position of the guide plate in the decurling device according to the exemplary embodiment.

First, referring to FIG. 10, the control device 150 checks whether the current situation applies to a condition for executing position adjustment. Herein, the "condition for executing position adjustment" may be defined according to need. For example, every medium S may be subjected to position adjustment, or any thick medium S having a predetermined thickness or greater may be subjected to position adjustment on the basis of operation information transmitted from the operation panel 40.

Figure 12B:
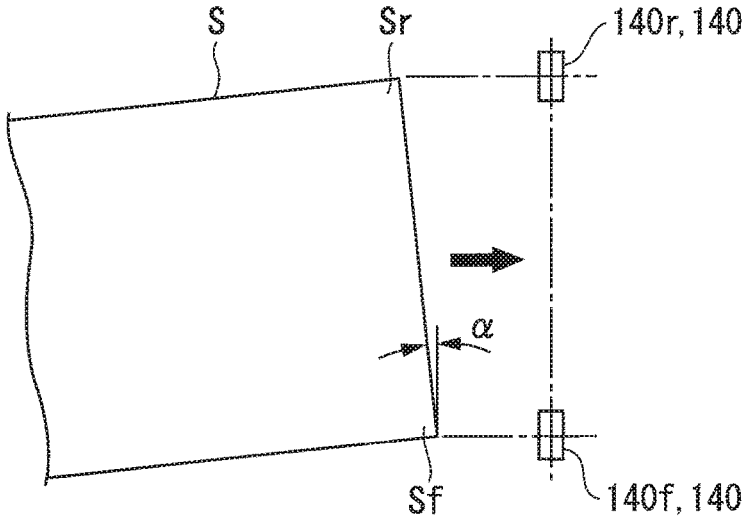
FIG. 12B illustrates a principle of skew detection to be performed if the medium is skewed with the front side thereof advancing ahead.

If the current situation applies to the condition for executing position adjustment, the skew detecting devices 140 (140*f* and 140*r*) each detect position information. In this step, as illustrated in FIGS. 12A and 12B, if the front side of the medium S advances ahead, specifically, if the front corner Sf of the medium S passes the skew detecting device 140 earlier than the rear corner Sr, it is determined that the medium S is skewed with the front side thereof advancing ahead by an angle α. Thus, the amount of skew of the medium S is calculated.

Figure 12C:
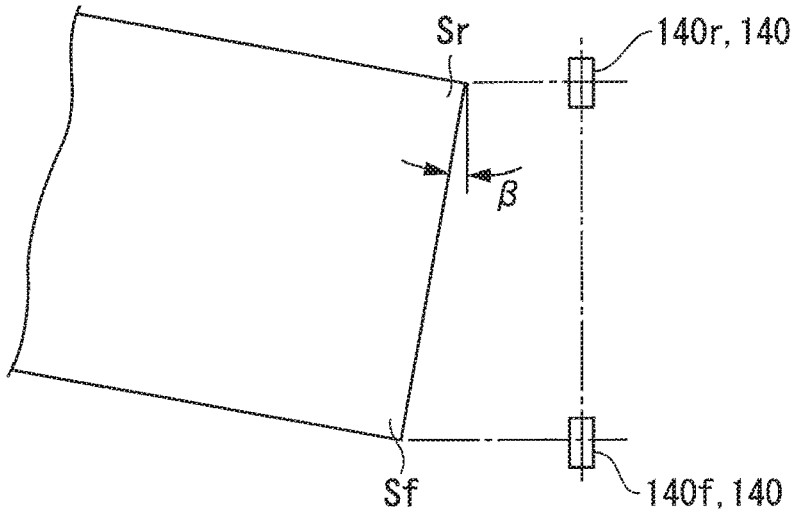
FIG. 12C illustrates a principle of skew detection to be performed if the medium is skewed with the rear side thereof advancing ahead.

On the other hand, as illustrated in FIGS. 12A and 12C, if the rear side of the medium S advances ahead, specifically, if the rear corner Sr of the medium S passes the skew detecting device 140 earlier than the front corner Sf, it is determined that the medium S is skewed with the rear side thereof advancing ahead by an angle β. Thus, the amount of skew of the medium S is calculated.

Subsequently, the control device 150 checks whether the calculated amount of skew is over a tolerance. If the calculated amount of skew exceeds the tolerance, the control device 150 determines the respective lengths of travel of the two ends of the support shaft 110 supporting the guide plate 101.

In the present exemplary embodiment, the lengths of travel determined in this step are the amounts of adjustment in the medium transporting direction that are calculated with reference to a center position of the guide plate 101 in the medium crosswise direction (in the present exemplary embodiment, the widthwise direction of the medium S).

Subsequently, the control device 150 transmits control signals based on the determined lengths of travel to the driving motors 132 of the respective position adjusting mechanisms 130 (130*a* and 130*b*), thereby variably adjusting the individual positions of the two ends of the support shaft 110 supporting the guide plate 101.

Figure 13A:
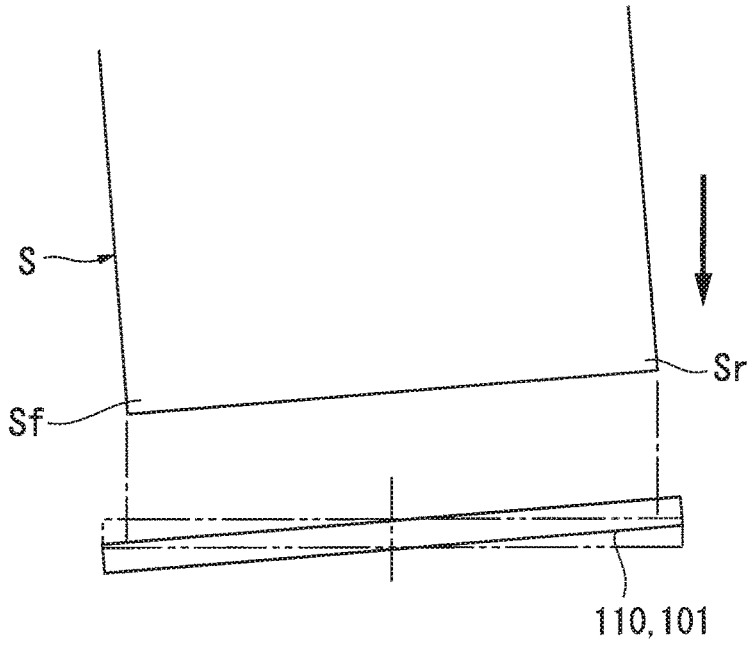
FIG. 13A schematically illustrates a principle of skew correction to be performed by the decurling device if the medium is skewed with the front side thereof advancing ahead.

In this step, for example, if the front side of the medium S advances ahead as illustrated in FIG. 13A, the support shaft 110 of the guide plate 101 is tilted in such a manner as to substantially conform to the state of skew of the medium S whose front side advances ahead.

Figure 13B:
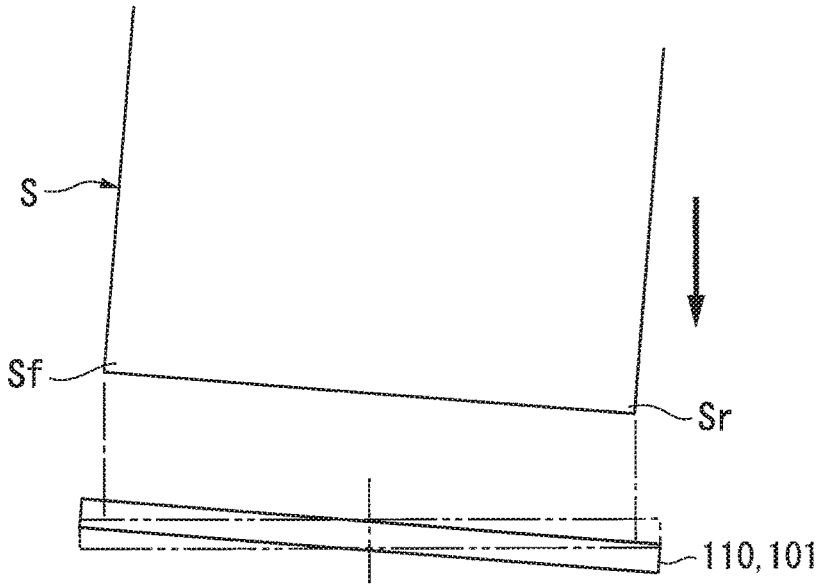
FIG. 13B schematically illustrates a principle of skew correction to be performed by the decurling device if the medium is skewed with the rear side thereof advancing ahead.

On the other hand, if the rear side of the medium S advances ahead as illustrated in FIG. 13B, the support shaft 110 of the guide plate 101 is tilted in such a manner as to substantially conform to the state of skew of the medium S whose rear side advances ahead.

Consequently, the guiding surfaces 104 of the guide plate 101 are tilted at the same angle as the support shaft 110 of the guide plate 101.

Hence, for example, even if the medium S is a thick medium and is skewed to an extent over a tolerance after passing through the fixing device 70, the guiding surfaces 104 of the guide plate 101 of the decurling device 100 are adjusted to be positioned substantially parallel to the skewed leading end of the medium S. Therefore, the medium S substantially evenly comes into contact with the guiding surfaces 104 of the guide plate 101.

According to the present exemplary embodiment, in the above process of adjusting the tilt of the guiding surfaces 104 of the guide plate 101 in the medium crosswise direction, substantially the same length of travel may be set for the two crosswise ends of the guide plate 101 with reference to the center position of the guide plate 101 in the medium crosswise direction (in the present exemplary embodiment, the widthwise direction of the medium S).

Figure 13C:
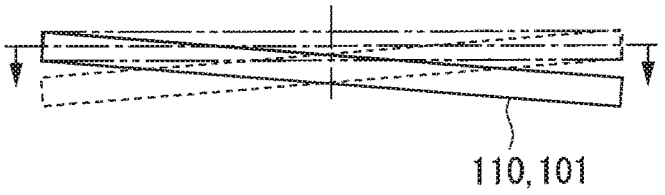
FIG. 13C illustrates another method of skew correction to be performed by the decurling device.

The present exemplary embodiment concerns a case where the tilt of the guiding surfaces 104 of the guide plate 101 in the medium crosswise direction is adjusted with reference to the center position of the guide plate 101 in the medium crosswise direction. However, the exemplary embodiment is not limited to such a case. For example, as illustrated by a solid line or a dotted line in FIG. 13C, if one end of the support shaft 110 of the guide plate 101 in the medium crosswise direction is fixed, the position of the other end of the support shaft 110 may be variably adjusted. The support shaft 110 is initially positioned as illustrated by a two-dot chain line in FIG. 13C. Note that attention should be paid so as not to cause the transporting roller 91 provided close to the decurling device 100 and the guide plate 101 to interfere with each other.

After the medium S passes the guide plate 101, the control device 150 sets the support shaft 110 of the guide plate 101 to the initial position.

While the above exemplary embodiment concerns a case where the image forming apparatus employs an electrophotographic method, the present disclosure may also be applied to an image forming apparatus employing any other method such as an inkjet method, a relief printing method, a planographic method, an intaglio printing method, or the like. For example, if a recording medium tends to curl with the use of a drying device positioned subsequently to the image forming apparatus, such a curl may be straightened by using the decurling device according to the above exemplary embodiment.

The present disclosure may also be applied to an image forming apparatus employing a thermal transfer method implemented with rollers. For example, if a sheet-type medium as an object of transfer tends to curl after an image is thermally transferred thereto, such a curl may be straightened by using the decurling device according to the above exemplary embodiment.

The present disclosure may also be applied to an apparatus other than an image forming apparatus, such as a thermocompression bonding apparatus that bonds a sheet-type medium and a film to each other by applying heat and pressure thereto with rollers. In such a case, if the medium tends to curl after a thermocompression process, the decurling device according to the above exemplary embodiment may be used.

Note that the drying device, the thermal transfer device, and the thermocompression bonding apparatus are each an example of the heating device according to the present disclosure.

The present disclosure may also be applied to a case of straightening a medium curled by any factor other than heat. For example, the present disclosure may be applied to a case of straightening a sheet-type medium curled by a factor such as an environment (temperature, humidity, and so forth) for storing the sheet-type medium.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A decurling device provided on a downstream side with respect to a fixing device in a medium transporting direction and that straightens a curl formed in a medium transported to the decurling device, the decurling device comprising:

a bending unit that extends across the medium transporting direction and that bends the medium in a decurling direction by coming into contact with a leading end of the medium;

a position adjusting unit that adjusts, in a medium crosswise direction, tilt of a contact part of the bending unit, the contact part coming into contact with the leading end of the medium exited from the fixing device at a position away from the fixing device; and a transporting unit that is provided between the fixing device and the bending unit and that transports the medium while nipping the medium, wherein the transporting unit includes a plurality of separate transporting members arranged at intervals in the medium crosswise direction and each having a nipping site where the medium is nipped.

2. The decurling device according to claim 1, wherein the bending unit includes a plate-shaped guiding member positioned in a predetermined orientation with a part of the guiding member serving as a support point, the guiding member guiding the leading end of the medium.

3. The decurling device according to claim 2, wherein the bending unit includes an urging unit that urges the guiding member toward the medium.

4. The decurling device according to claim 3, wherein the guiding member of the bending unit is positioned avoiding the separate transporting members.

5. The decurling device according to claim 2, wherein the guiding member of the bending unit is positioned avoiding the separate transporting members.

6. The decurling device according to claim 1, wherein the bending unit has a support point at each of two ends in the medium crosswise direction, and wherein the position adjusting unit is capable of adjusting individual positions of the support points at the two ends of the bending unit.

7. The decurling device according to claim 6, wherein the position adjusting unit adjusts the tilt of the contact part of the bending unit by determining an amount of adjustment in the medium transporting direction with reference to a center position of the bending unit in the medium crosswise direction.

8. The decurling device according to claim 6, wherein the position adjusting unit includes a moving unit that moves the support points of the bending unit in a direction substantially parallel to the medium transporting direction; and a restricting unit that restricts ranges of movement of the respective support points.

9. An image forming apparatus comprising:

a heating device that heats a medium; and the decurling device according to claim 1 that is provided on a downstream side with respect to a fixing device in a medium transporting direction, the decurling device straightening a curl formed in a medium transported to the decurling device.

10. A decurling device provided on a downstream side with respect to a fixing device in a medium transporting direction and that straightens a curl formed in a medium transported to the decurling device, the decurling device comprising:

a bending unit that extends across the medium transporting direction and that bends the medium in a decurling direction by coming into contact with a leading end of the medium;

a position adjusting unit that adjusts, in a medium crosswise direction, tilt of a contact part of the bending unit, the contact part coming into contact with the leading end of the medium exited from the fixing device at a position away from the fixing device;

a skew detector that detects a state of skew of the medium exited from the fixing device with respect to a reference line extending in the medium transporting direction;

a controller that controls a length of travel of the position adjusting unit in accordance with information detected by the skew detector; and a transporting unit that is provided between the fixing device and the bending unit and that transports the medium while nipping the medium, wherein the transporting unit includes a plurality of separate transporting members arranged at intervals in the medium crosswise direction and each having a nipping site where the medium is nipped.

11. The decurling device according to claim 2, wherein the bending unit includes a plate-shaped guiding member positioned in a predetermined orientation with a part of the guiding member serving as a support point, the guiding member guiding the leading end of the medium.

12. The decurling device according to claim 11, wherein the bending unit includes an urging unit that urges the guiding member toward the medium.

13. The decurling device according to claim 12, wherein the guiding member of the bending unit is positioned avoiding the separate transporting members.

14. The decurling device according to claim 11, wherein the guiding member of the bending unit is positioned avoiding the separate transporting members.

15. The decurling device according to claim 10, wherein the bending unit has a support point at each of two ends in the medium crosswise direction, and wherein the position adjusting unit is capable of adjusting individual positions of the support points at the two ends of the bending unit.

16. The decurling device according to claim 15, wherein the position adjusting unit adjusts the tilt of the contact part of the bending unit by determining an amount of adjustment in the medium transporting direction with reference to a center position of the bending unit in the medium crosswise direction.

17. The decurling device according to claim 15, wherein the position adjusting unit includes a moving unit that moves the support points of the bending unit in a direction substantially parallel to the medium transporting direction; and a restricting unit that restricts ranges of movement of the respective support points.

18. The decurling device according to claim 10, wherein the controller executes the adjustment of the position of the bending unit with the position adjusting unit when a result of detection by the skew detector exceeds a tolerable range.

19. The decurling device according to claim 10, wherein the controller executes the adjustment of the position of the bending unit with the position adjusting unit in a thick-medium mode in which the medium has a predetermined thickness or greater.

* * * * *